US007100372B2

(12) United States Patent
Ohshita et al.

(10) Patent No.: US 7,100,372 B2
(45) Date of Patent: Sep. 5, 2006

(54) VEHICLE AIR COMPRESSOR DEVICE

(75) Inventors: Morito Ohshita, Kariya (JP); Masakazu Ohashi, Toyota (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 167 days.

(21) Appl. No.: 10/768,145

(22) Filed: Feb. 2, 2004

(65) Prior Publication Data

US 2004/0228743 A1 Nov. 18, 2004

(30) Foreign Application Priority Data

Jan. 31, 2003 (JP) ..... 2003-023575
Jan. 23, 2004 (JP) ..... 2004-015328

(51) Int. Cl.
*F15B 21/04* (2006.01)

(52) U.S. Cl. ..... 60/453; 92/79; 417/313

(58) Field of Classification Search ..... 60/453; 92/78, 79; 417/313, 415
See application file for complete search history.

(56) References Cited

U.S. PATENT DOCUMENTS 1,872,805 A * 8/1932 Peterson ..... 92/79
3,472,000 A * 10/1969 Bridigum et al. ..... 96/113
4,331,457 A * 5/1982 Morner ..... 96/116
4,955,994 A * 9/1990 Knight et al. ..... 96/113
5,129,927 A * 7/1992 Tsubouchi ..... 96/113
5,427,609 A * 6/1995 Zoglman et al. ..... 95/98
5,600,953 A 2/1997 Oshita et al.
5,711,150 A * 1/1998 Oshita et al. ..... 60/407
6,006,520 A * 12/1999 Zehnder et al. ..... 60/415
6,074,177 A 6/2000 Kobayashi et al.

FOREIGN PATENT DOCUMENTS

DE 195 35 972 C2 2/1997
JP 11-264375 9/1999

* cited by examiner

*Primary Examiner*—Edward K. Look
*Assistant Examiner*—Michael Leslie
(74) *Attorney, Agent, or Firm*—Buchanan Ingersoll & Rooney PC

(57) ABSTRACT

The present invention provides a vehicle air compressor device which includes a motor device serving as a driving power source, and a drier device that conducts compressed air; the drier device arranged opposite to the motor device; and a supporting member for supporting the air compressor device on a vehicle at a portion where the motor device and the drier device are adjacent to each other.

11 Claims, 5 Drawing Sheets

VEHICLE AIR COMPRESSOR DEVICE

This application is based on and claims priority under 35 U.S.C. § 119 with respect to Japanese Patent Application No. 2003-023575 filed on Jan. 31, 2003 and Japanese Patent Application No. 2004-015328 filed on Jan. 23, 2004, the entire contents of which are incorporated herein by reference.

FIELD OF THE INVENTION

The present invention relates to an air compressor device. More particularly, the present invention pertains to an air compressor device used for a vehicle air suspension device.

BACKGROUND OF THE INVENTION

Known air compressor devices for supplying compressed air to a vehicle air suspension device are described in the U.S. Pat. No. 6,074,177 and Japanese Patent Laid-Open Publication No. Hi 1(1999)-264375. This air compressor device includes a motor portion serving as a driving power source, a piston crank portion connected to an output shaft of the motor portion, a piston that generates compressed air, and a drier portion for removing water and/or moisture drops from the air compressed by the piston crank portion.

The motor portion and drier portion of air compressor devices are arranged in parallel with each other onboard the vehicle. The known air compressors further include the piston crank portion being connected, at a first end, to the motor portion and, at a second end, to the drier portion so that the vehicle air compressor device forms an approximately U shaped unit when the motor portion, piston crank portion and drier position are connected to each other.

There is a demand for improving the throughput efficiency of the design by standardizing the design as much as possible so that the air compressor device can accommodate various vehicle characteristics. In order to meet this demand, a design flexibility is required. Although the motor portion and the drier portion are arranged in parallel with each other and the motor portion is mounted with the drier portion of the air compressor device, a size reduction and simplification of the components are needed due to the space limitations and/or dimensions of vehicles.

Further, a design should be capable of modification in response to different specifications of the vehicle's air compressor device, for example, a stroke of the piston has to be changed so that the volume of the supplied, compressed air can be modified. Among the known counter measures taken in order to meet the foregoing specification requests on the device, the center of mass of the motor device and the center of mass of the drier portion are moved away from each other and so the length of the piston crank provided between the motor device and the drier portion gets longer. This can increase vibrational loads in the on-board environment, for example, the motor device and the drier portion are more affected by vibration from the vehicle body. Further, because the motor device and the drier portion comprising the main portion of the air compressor device are likely influenced by vibration, a structure with high vibration resistance has been required.

A need thus exists for a vehicle air compressor device which meets a design standardization requirement including high performance on vibration resistance and downsizing.

SUMMARY OF THE INVENTION

In light of the foregoing, the present invention provides a vehicle air compressor device which includes a motor device serving as a driving power source, a drier device conducting compressed air; the drier device arranged opposite to the motor device; and a supporting member for supporting the air compressor device on a vehicle at a portion where the motor device and thedrier device are adjacent to each other.

BRIEF DESCRIPTION OF THE DRAWING FIGURES

The foregoing and additional features and characteristics of the present invention will become more apparent from the following detailed description considered with reference to the accompanying drawings and figures in which like reference numerals designate like elements.

Figure 5A:
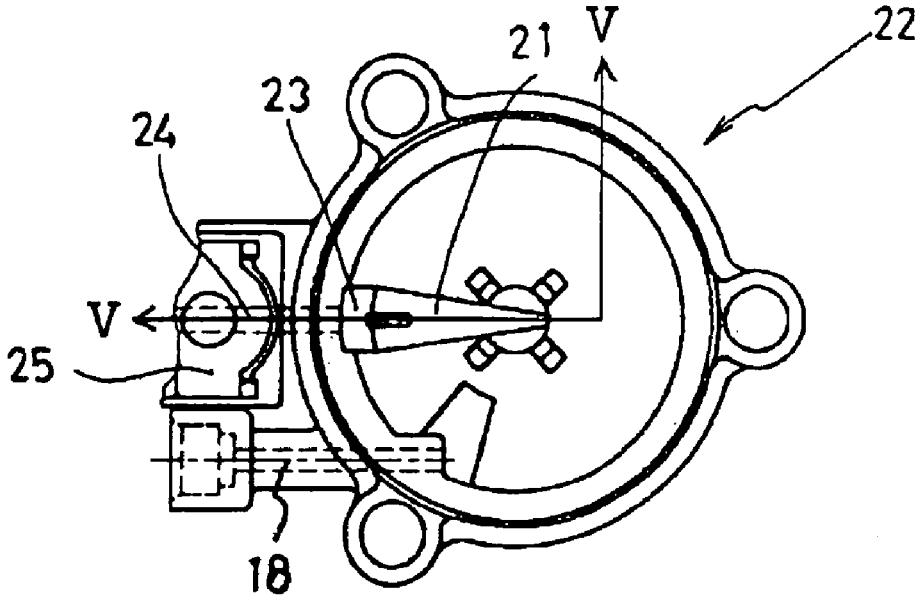

FIG. 5*a* is a top view showing a water collecting portion of the drier cover.

Figure 5B:
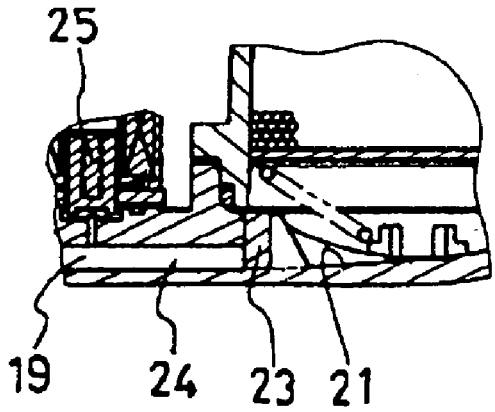

FIG. 5*b* is a vertical cross-sectional view of the water collecting portion taken along the line V—V in FIG. 5*a*.

Figure 4:
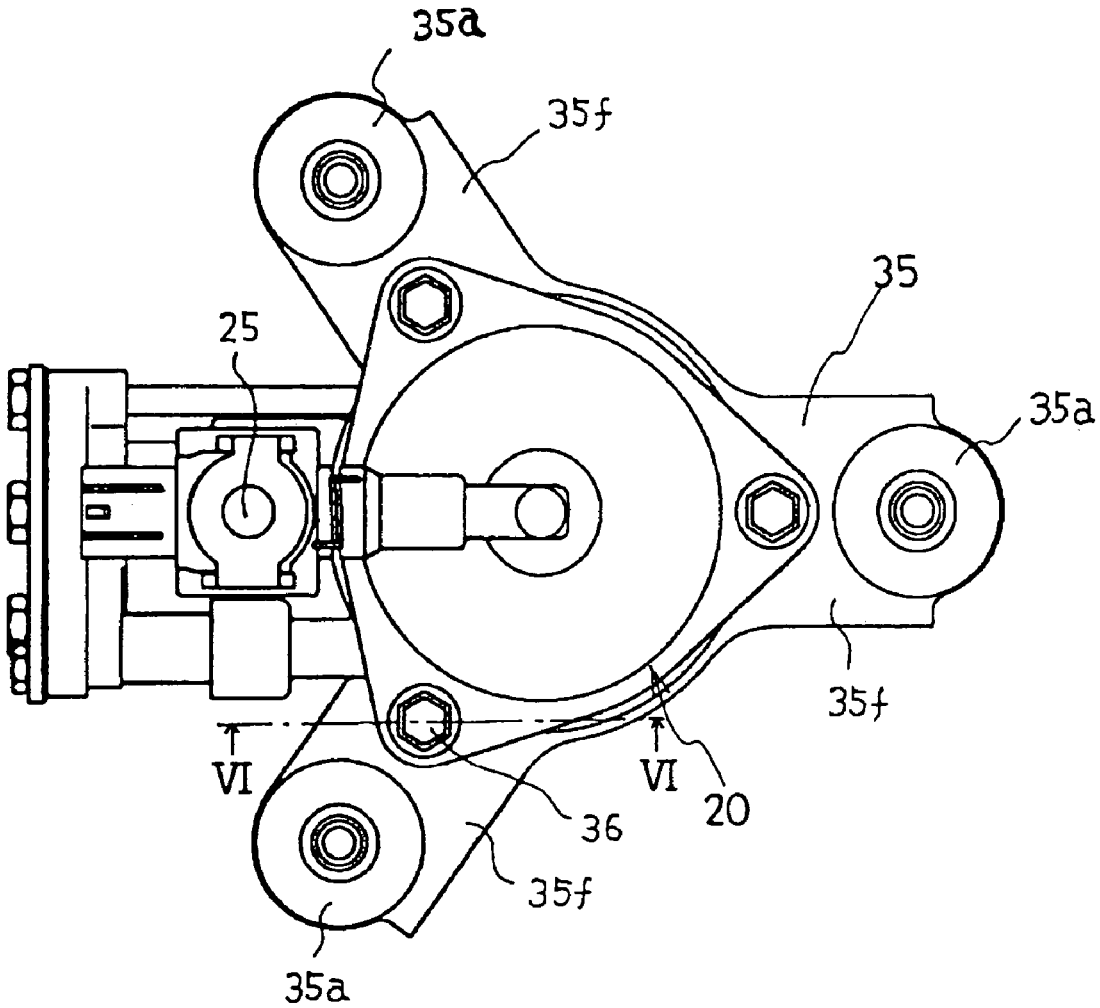
FIG. 4 is a top view showing an arrangement of a bracket of FIG. 1.
Figure 6:
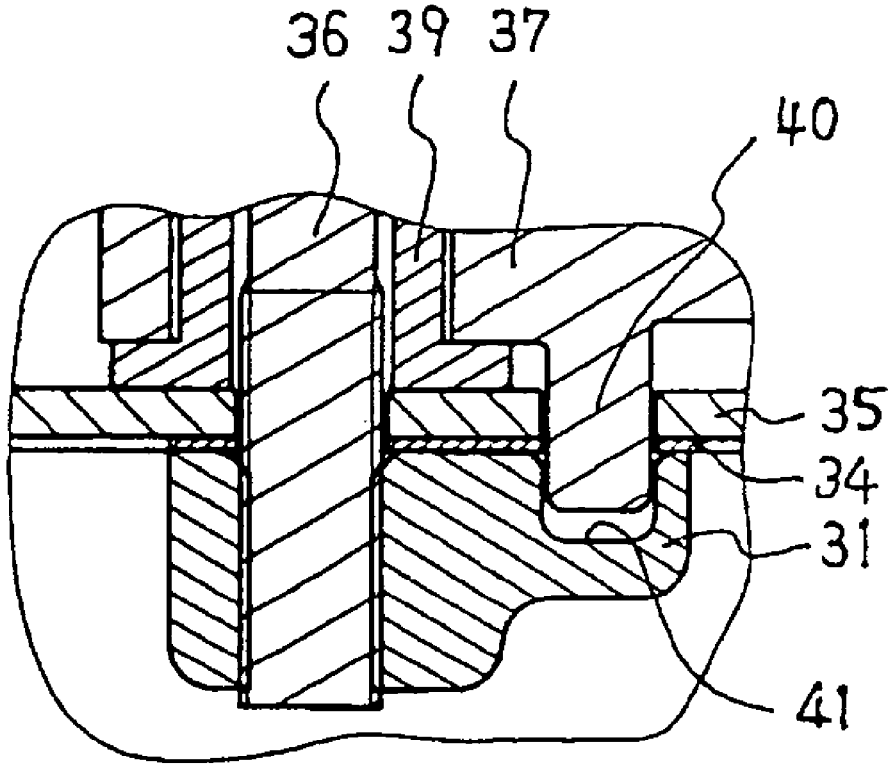

FIG. 6 is a cross-sectional view of the drier cover and the motor housing taken along the line VI—VI in FIG. 4.

DETAILED DESCRIPTION OF THE INVENTION

Embodiments of the present invention will be explained with reference to the accompanying drawings and figures.

Figure 1:
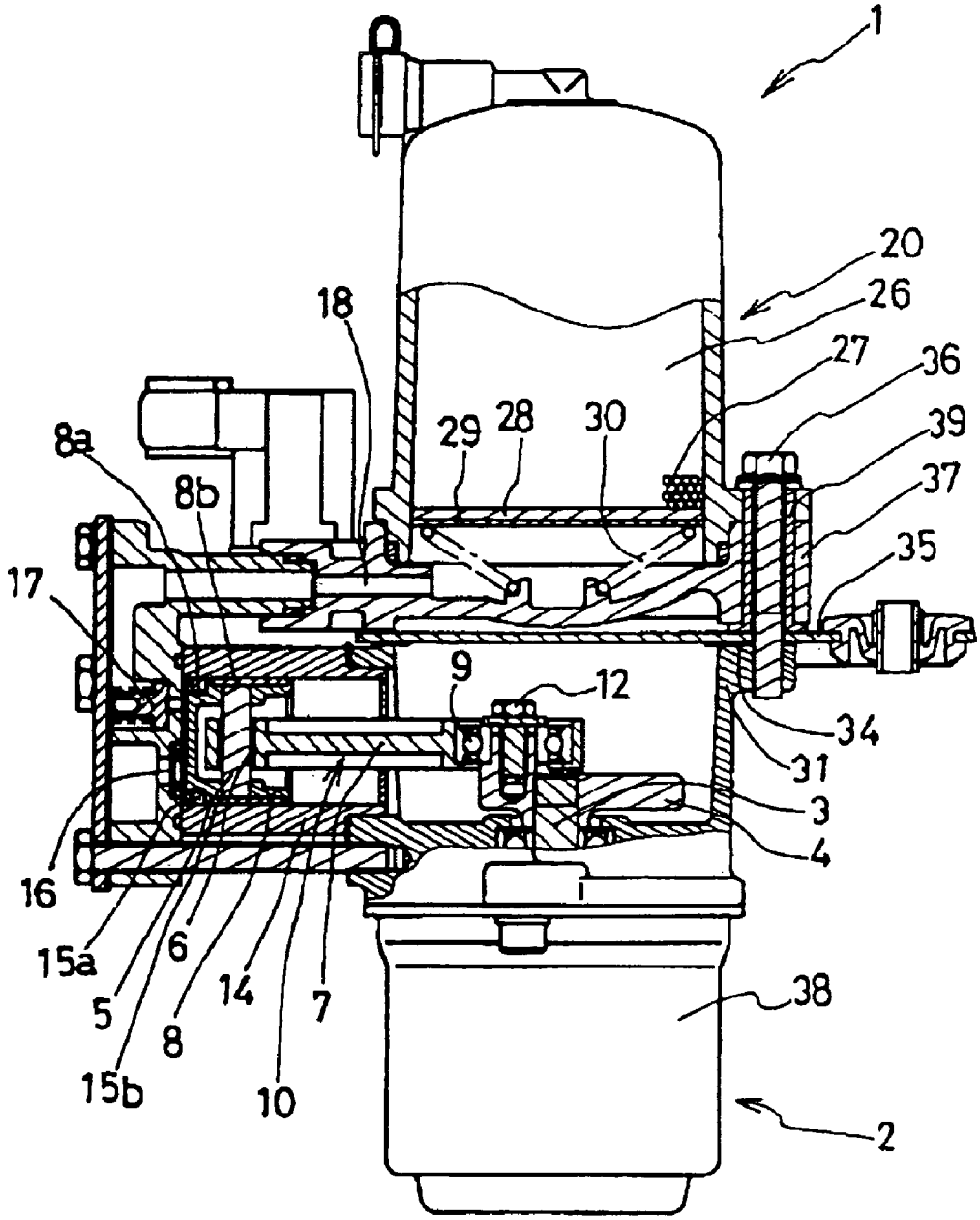
FIG. 1 is a vertical cross-sectional view showing a vehicle air compressor device according to a first embodiment of the present invention.

As shown in FIG. 1, an air compressor device 1 for a vehicle includes a drier device 20 positioned opposite to an output shaft 3 of a motor device 2 in the axial direction. A piston crank device 10 includes a crank 4 tightly linked to the output shaft 3 of the motor device 2, a piston 8 connected to a connecting rod 7 supporting a bearing 9 at the crank 4 side end portion via a pin 5 and a pin bush 6, and a bolt 12.

Piston seals 15*a*, 15*b* are engaged and inserted into grooves 8*a*, 8*b* respectively formed in the piston crank device 10 so that the piston 8 can slide smoothly in a cylinder 14. A suction valve 16 for sucking air is provided at a head side of the piston 8. A discharge valve 17, also arranged at the head side of the piston 8, operates as a directional valve for supplying the compressed air through a conduit 18 to the drier device 20. The conduit 18 for supplying the compressed air to the drier device 20 is formed to extend back approximately in parallel with the moving direction of the piston 8.

A water collecting portion 22 shown in FIGS. 5*a*, 5*b* is provided at a bottom portion of the drier device 20 and adjacent to an opening portion of the conduit 18. The water collecting portion 22 includes a tapered surface for collecting water or moisture drop and has a slope 21 for guiding water to a drain outlet 19. A filter 23 is provided at a lower portion of the slope 21. An exhaust air passage 24 and an exhaust air valve 25 are provided forward of the filter 23. Collected water in the water collecting portion 22 is discharged to the atmosphere with the compressed air passing the drain outlet 19 through the exhaust air valve 25, which is controlled by a controller. The water collecting portion 22, the exhaust air passage 24 and the exhaust air valve housing are made of resin or of plating metal, or are made with a corrosion resistant coating. A chamber 26 of the drier device 20 is provided at the upper portion of the water collecting portion 22. Desiccant 27 is filled in the chamber 26 and supported by a filter 28 and a plate 29 upwardly urged by a spring 30. A check valve orifice is provided at an upper side of the chamber 26 or in the middle of a tube or a pipe connected to an air cylinder tightly held to the vehicle body, or the like. The check valve orifice controls the flow of compressed air to the air suspension so that compressed air flows without resistance when the compressed air is supplied to the air cylinder and only a regulated amount of compressed air flows when the compressed air returns from the air cylinder to the chamber 26 of the drier device 20.

A gasket 34 serving as the sealing member and a bracket 35 are sandwiched between the drier cover 37 of the drier device 20 and the motor housing 31. Also, the gasket 34 may be provided between the drier cover 37 and the bracket 35. The bolt 36 is fastened after equipping a collar 39 so that an axial force does not affect the chamber 26 and the drier cover 37 of the drier device 20.

The motor housing 31, the drier device 20 including the drier cover 37, the gasket 34 and the bracket 35 are fastened altogether by the bolt 36.

As shown in FIG. 4, the bracket 35 has a plurality of flange portions 35*f* that are radially extending. The bracket 35 is supported by the vehicle body through fixing portions 35*a* formed at the top end of the flange portions 35*f*. The length of the flange portions 35*f* are determined according to the clearance for fixing on the vehicle body.

FIG. 6 shows a cross-sectional view of the motor housing 31 and a drier cover 37 taken along the line VI—VI of FIG. 4. As shown in FIG. 6, the drier cover 37 has at least two sets of projected portions 40 and the motor housing 31 has at least two sets of concave portions 41 for defining the circumferential position between the motor housing 31 and the drier cover 37. The projected portion 40 and concave portion 41 are used to adjust and define the assembly position between the motor housing 31 and the drier cover 37. For instance, if the position of the projected portions 40 and the concave positions 41 are asymmetrically designed, an incorrect assembling can be prevented.

Figure 2:
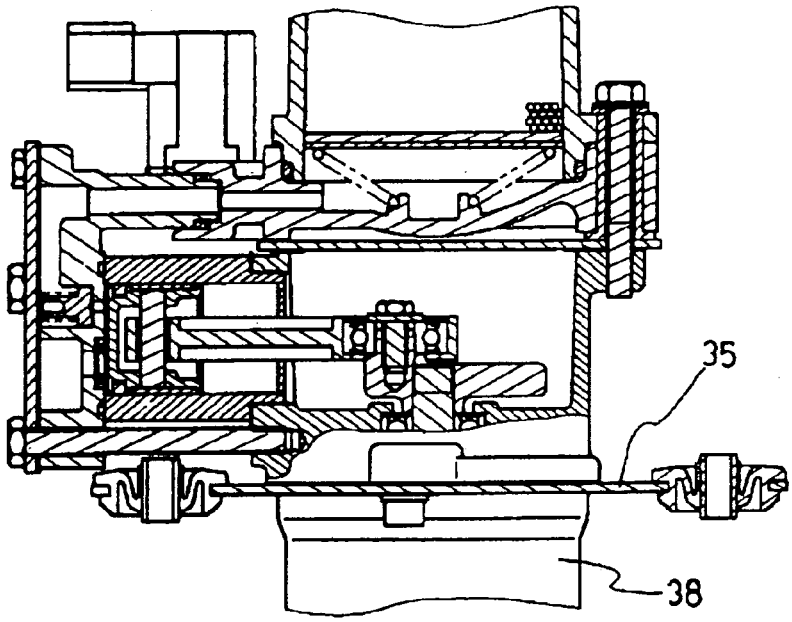
FIG. 2 is a partial cross-sectional view showing a second embodiment of the vehicle air compressor device including another arrangement of the bracket serving as a supporting member.

As shown in FIG. 2, a second embodiment of the present invention includes another arrangement of the bracket 35 provided at the air compressor device 1. As shown in FIG. 2, the bracket 35 and a motor cover 38 are unitarily formed with the single member or plural members.

Figure 3:
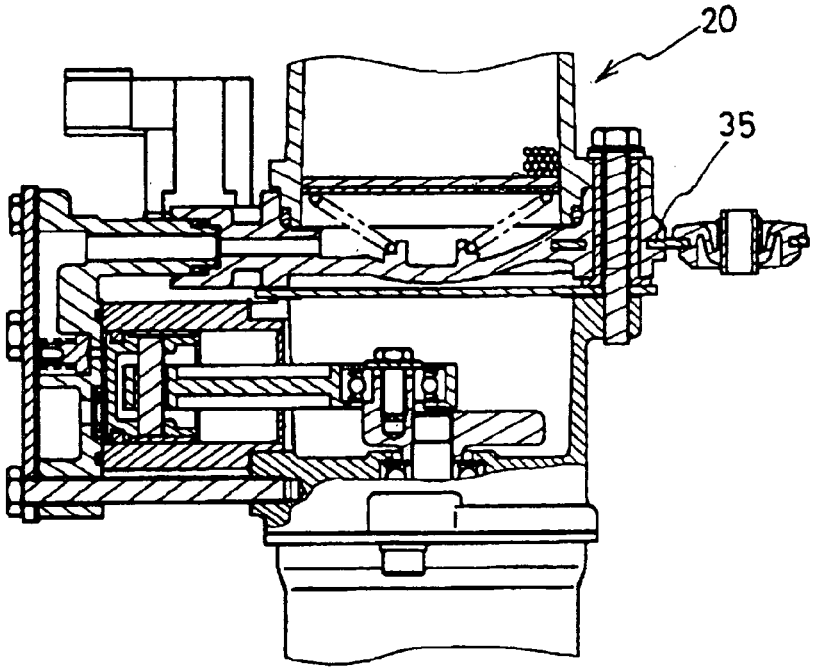
FIG. 3 is a partial cross-sectional view showing a third embodiment of the vehicle air compressor device including another arrangement of the bracket serving as a supporting member.

As shown in FIG. 3, a third embodiment of the present invention includes another configuration of the bracket 35 provided on the air compressor device 1. As shown in FIG. 3, the drier device 20 is unitarily formed with the bracket 35 with insert molding. The air compressor 1 is fixed to a vehicle frame member via the bracket 35 and the bolt directly or through another supporting member.

As stated in the foregoing explanation, the bracket 35 may be formed unitarily or may be unitarily assembled with the motor device 2, the drier device 20, or the like. Since the bracket 35 is positioned relatively close to the piston crank device 10, the entire air compressor device 1 can be supported at the center of balance of the air compressor device 1. Further, since the assembled position of the bracket 35 is close to the piston crank device 10 corresponding to the movable portion, vibration from the air compressor device 1 can be restrained against vibration by the piston actuation.

An operation of the embodiment of the present invention will be explained as follows. The air compressor device 1 of this invention is widely applicable to air compressor systems, and the usage of the air compressor device 1 of the present invention is not limited to this embodiment.

In order to lift-up the vehicle height, the suction valve 16 is opened to introduce air into a compression space in the cylinder 14. Then the air is compressed by the piston crank device 10 that is driven by the motor device 2 so as to generate compressed air. Next, the compressed air is introduced to the drier device 20. The absorbed water in the compressed air is sent to the drier 20 via the conduit 18. Thereafter, the desiccant 27 in the drier device 20 gets rid of absorbed water in the compressed air.

The compressed air dried by the desiccant 27 in the chamber 26 of the drier device 20 is sent to the air cylinder via the check valve orifice of the chamber 26 in order to lift-up the vehicle height.

In order to lower the vehicle height, the discharging air valve 25, shown in the FIG. 5*a*, is opened so that the compressed air in the air suspension system is discharged and the compressed air is released to the atmosphere via the outlet 19 and the discharging air passage 24. Accordingly, the discharging air valve 25 enables the lowering of the vehicle height.

Since the compressed air is taking some heat away, the compressed air has a high temperature. Some water vapor is condensed and moves to the water collecting portion 22. The conduit 18 may be elongated to a predetermined length in order to gain a cooling effect. The conduit 18 is made of materials having sufficient cooling efficiency.

By forming the conduit 18 with the metal member, for example, the cooling efficiency can be further increased. In that case, the corrosion resistance has to be considered without destroying the metal property.

Since the relative movement between the motor device and the drier device is restricted by fixing the two using a single bracket, it is not required to support the motor device and the drier device with a plurality of supporting members. Also, since the supporting member is positioned at an intermediate position between the motor device and the drier device, the supporting member can be placed close to the center of balance of the air compressor device. Thus, vibration transmitted from the vehicle body to the air compressor device is decreased as compared to the conventional configuration of an air compressor device. Further, the supporting member is provided close to the piston crank device, which corresponds to the moving portion of the vehicle air compressor device.

According to the embodiments, by designing the supporting member to be supported with the drier device or the motor device, the supporting member enhances an anti-vibration efficiency.

According to the embodiments, the supporting member is unitarily assembled with the drier device or the motor device by unitarily assembling the supporting member with the drier device and the motor device or simultaneously the motor device with the same fastening member or connection member or the like, easy assembly is achieved because of the reduction of component parts.

According to the embodiments, since the conduit for supplying the compressed air to the drier device is formed to have a longer stroke than the piston stroke, the compressed air is cooled when passed through the conduit. Thus, compressed air containing water vapor is condensed.

Because water or vapor drops are purged from humid, compressed air, water absorbed desiccant in the drier device can be relatively reduced. According to the embodiments, since the conduit may be made of a metal having a sufficient cooling efficiency, the drier device can be downsized in design because the desiccant may be cut down in the chamber volume.

According to the embodiments, by arranging a part of the conduit in parallel with the moving direction of the piston, for example, by providing the conduit along the piston crank device, the dead space between the motor device and the drier device is reduced in the vehicle air compressor device.

According to the embodiments, the water collecting portion including the inclination and the space for collecting water that remains in the conduit is provided at the open end portion of the conduit for discharging the water to the atmosphere in a predetermined condition. This structure reduces the size of the drier device and thus the total size of the air compressor device.

Accordingly, with the structure of the embodiments, dead space between the motor device and the drier device of the vehicle air compressor device is reduced, and there is a reduction in assembly time. Further, the design complies with standardization requirements without significant design changes in order to accommodate the various different specifications on the air compressor devices.

The principles, preferred embodiment and mode of operation of the present invention have been described in the foregoing specification. However, the invention which is intended to be protected is not to be construed as limited to the particular embodiments disclosed. Further, the embodiment described herein is to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A vehicle air compressor device comprising:

a motor device serving as a driving power source and having an output shaft;

a compressed air generation device connected to the output shaft to generate compressed air;

a drier device to which the compressed air is conducted; and the drier device opposes the motor device in an axial direction of the output shaft; and a supporting member for supporting the motor device, the compressed air generation device and the drier device on a vehicle, and the supporting member is positioned between the motor device and the drier device.

2. The vehicle air compressor device according to claim 1 wherein the supporting member is pinched and supported by the drier device or by the motor device.

3. The vehicle air compressor device according to claim 1, wherein the supporting member is unitarily assembled with the drier device or with the motor device.

4. The vehicle air compressor device according to claim 1, further including a piston crank device for generating compressed air, wherein the piston crank device is attached to the drier device and the motor device.

5. The vehicle air compressor device according to claim 4, wherein a conduit is provided between the piston crank device and the drier device.

6. The vehicle air compressor device according to claim 5, wherein the conduit is configured to be longer than a stroke length of the piston crank device.

7. The vehicle air compressor device according to claim 1, wherein the drier device includes an inclination inclined towards an axis of the drier device.

8. A vehicle air compressor device according to claim 1, wherein the compressed air generation device is a piston crank device having a piston, and the piston crank device is mutually linked as a unit to the motor device and the drier device.

9. The vehicle air compressor device according to claim 8, wherein the supporting member mutually links among the piston crank device, the drier device and the motor device.

10. The vehicle air compressor device according to claim 9, wherein the supporting member is unitarily assembled with drier device or with the motor device.

11. The vehicle air compressor device according to claim 8, wherein the drier device includes an inclination inclined towards an axis of the drier device.

* * * * *